US005819762A

United States Patent [19]

Kim

[11] Patent Number: 5,819,762

[45] **Date of Patent: *Oct. 13, 1998**

[54] HAIR WINDER FOR PERMANENT WAVES

[75] Inventor: Hyeong Suk Kim, Kowloon, Hong Kong

[73] Assignee: Georg Wiegner, Kowloon, Hong Kong

[ * ] Notice: The term of this patent shall not extend beyond the expiration date of Pat. No. 5,715,846.

[21] Appl. No.: 630,877

[22] Filed: Apr. 2, 1996

Related U.S. Application Data

[63] Continuation-in-part of Ser. No. 554,594, Nov. 6, 1995, abandoned, which is a continuation-in-part of Ser. No. 284,095, Aug. 1, 1994, Pat. No. 5,538,021.

[30] Foreign Application Priority Data

Nov. 1, 1995 [DE] Germany ..... 195 40 684.2

[51] Int. Cl.[6] ..... A45D 2/00

[52] U.S. Cl. ..... 132/222; 132/245

[58] Field of Search ..... 132/222, 226, 132/245, 262, 210

[56] References Cited

U.S. PATENT DOCUMENTS

| | | | |
|---|---|---|---|
| Re. 27,033 | 1/1971 | Mitsumoto . | |
| 871,055 | 7/1907 | Freeman . | |
| 1,718,025 | 6/1929 | Bishinger . | |
| 1,994,099 | 3/1935 | Fulton | 132/222 |
| 2,166,386 | 7/1939 | Auster . | |
| 2,171,885 | 9/1939 | MIchael . | |

(List continued on next page.)

FOREIGN PATENT DOCUMENTS

| | | |
|---|---|---|
| 0 197 208 | 4/1985 | European Pat. Off. . |
| 0 460 452 A1 | 5/1991 | European Pat. Off. . |
| 1 247 508 | 11/1959 | France . |
| 1 404 587 | 5/1964 | France . |
| 2 382 212 | 3/1978 | France . |
| 2 503 996 | 4/1982 | France . |
| A 2 615 079 | 11/1988 | France . |
| 1793426 | 2/1959 | Germany . |
| 18 51 705 | 11/1961 | Germany . |
| 14 57 375 | 3/1969 | Germany . |
| 15 57 333 | 1/1972 | Germany . |
| 23 38 330 | 2/1975 | Germany . |
| 75 05 892 | 10/1975 | Germany . |
| 2426028 | 12/1975 | Germany . |
| 26 22 364 | 12/1976 | Germany . |
| 28 07 797 | 2/1978 | Germany . |
| 20 02 226 | 2/1979 | Germany . |
| 30 05 837 | 9/1980 | Germany . |
| 3309241 | 3/1983 | Germany . |
| 3230357A1 | 2/1984 | Germany . |
| 3616076 | 11/1987 | Germany . |
| G 93 11 823.6 | 8/1993 | Germany . |
| G 295 00 740.0 | 1/1995 | Germany . |
| 4 26 125 | 12/1966 | Switzerland . |
| A 2 192 786 | 1/1988 | United Kingdom . |
| WO88/00445 | 1/1988 | WIPO . |

*Primary Examiner*—Gene Mancene
*Assistant Examiner*—Pedro Philogene
*Attorney, Agent, or Firm*—Flehr Hohbach Test Albritton & Herbert, LLP; Steven F. Caserza

[57] ABSTRACT

A curler whose diameter increases in size as hair is being wound up by, at least at the beginning of a winding-up process, laying the self-gripping tape strip in one or more turns around the curling core and thus building up self-gripping tape material on the curling core. Since, due to the outwardly projecting protrusions, the self-gripping tape material is of a given thickness, with every turn produced by the self-gripping tape strip on the curling core, the diameter of the curler is increased. With a selected length of the self-gripping tape strip it can be achieved that the self-gripping tape is wound on the curler with complete surrounding layers providing an increased diameter which is present for the entire circumferential surface of the curler. The result is a universal curler with which a relatively large width of different hair lengths can be retained. A curler of this type replaces a plurality of self-sticking curlers of different diameter, requiring little sales space.

20 Claims, 3 Drawing Sheets

U.S. PATENT DOCUMENTS

| | | | |
|---|---|---|---|
| 2,331,065 | 10/1943 | Willat . | |
| 2,404,517 | 7/1946 | Molchan . | |
| 2,631,593 | 3/1953 | Madore . | |
| 2,634,593 | 3/1953 | Madore | 132/222 |
| 2,708,941 | 5/1955 | Field . | |
| 2,747,585 | 5/1956 | Allen et al. . | |
| 2,825,344 | 3/1958 | Lenois . | |
| 2,838,053 | 6/1958 | Zimmerman . | |
| 2,874,706 | 2/1959 | Ficicchy . | |
| 2,941,534 | 6/1960 | Otto et al. . | |
| 2,972,994 | 2/1961 | Ferens . | |
| 3,045,685 | 7/1962 | Cormier . | |
| 3,105,502 | 10/1963 | Mitchell . | |
| 3,106,213 | 10/1963 | Clare . | |
| 3,123,080 | 3/1964 | Brenn-Albertoni . | |
| 3,204,646 | 9/1965 | Chamberlin . | |
| 3,267,942 | 8/1966 | Maestral | 132/262 |
| 3,326,222 | 6/1967 | Rosenheim . | |
| 3,388,709 | 6/1968 | Morris . | |
| 3,530,863 | 9/1970 | Foster | 132/222 |
| 3,666,915 | 5/1972 | De Napoli . | |
| 3,700,853 | 10/1972 | Jensen et al. . | |
| 3,759,271 | 9/1973 | Caruso . | |
| 3,812,866 | 5/1974 | Morane . | |
| 3,881,500 | 5/1975 | Shinbashi et al. . | |
| 3,923,068 | 12/1975 | Gilman . | |
| 3,943,946 | 3/1976 | Gallegos | 132/222 |
| 4,298,787 | 11/1981 | Barradas . | |
| 4,431,012 | 2/1984 | Albertoni . | |
| 4,465,084 | 8/1984 | Fulgoni | 132/245 |
| 4,516,011 | 5/1985 | Jeffress et al. . | |
| 4,638,821 | 1/1987 | Smith . | |
| 4,687,010 | 8/1987 | Caruso . | |
| 4,699,159 | 10/1987 | Thaler . | |
| 4,771,797 | 9/1988 | Kosaka . | |
| 4,989,621 | 2/1991 | Keller | 132/222 |
| 5,007,443 | 4/1991 | Fulgoni . | |
| 5,117,090 | 5/1992 | Askins . | |
| 5,144,968 | 9/1992 | Rivera . | |
| 5,255,694 | 10/1993 | Caruso . | |
| 5,263,501 | 11/1993 | Maznik . | |
| 5,286,949 | 2/1994 | Simons . | |
| 5,309,930 | 5/1994 | Presser . | |

HAIR WINDER FOR PERMANENT WAVES

CROSS-REFERENCE TO RELATED APPLICATIONS

This Application is a continuation-in-part of Ser. No. 08/554,594, filed on Nov. 6, 1995, now pending, which in turn is a continuation-in-part of Ser. No. 08/284,095, filed on Aug. 1, 1994 U.S. Pat. No. 5,538,021. Priority is also claimed on German Application Number 195 40 684.2, which was filed on Nov. 1, 1995.

INTRODUCTION

1. Technical Field

The invention relates to a curler having a curling core and a self-gripping tape placed externally thereon which has outwardly projecting protrusions.

2. Background

Such self-sticking curlers for winding up a person's hair have the great advantage, over conventional curlers, that they can be used without additional closure means, such as clasps, cross-lips, etc., since they are automatically retained in the hair.

A disadvantage, however, is that, as with the conventional curlers, with the self-sticking curlers a relatively large number of curlers of different diameters are required in order for a suitable curler to be provided for every hair length. In general, at most three windings of hair can be securely retained by one curler, thus necessitating the provision of curlers of at least ten different diameters.

An object of the invention is therefore to provide a curler which substantially reduces the required number of different curlers with different diameters.

Another object is to provide an improved hair curler which can be readily used even by unskilled people but which will be free from drawbacks of earlier devices.

SUMMARY

The invention provides a curler whose diameter increases in size as hair is being wound up by, at least at the beginning of a winding-up process, laying the self-gripping tape strip in one or more turns around the curling core and thus building up self-gripping tape material on the curling core. Since, due to the outwardly projecting protrusions, the self-gripping tape material is of a given thickness, with every turn produced by the self-gripping tape strip on the curling core, the diameter of the curler is increased. With a selected length of the self-gripping tape strip it can be achieved that the self-gripping tape is wound on the curler with complete surrounding layers providing an increased diameter which is present for the entire circumferential surface of the curler. The result is a universal curler with which a relatively large width of different hair lengths can be retained. A curler of this type replaces a plurality of self-sticking curlers of different diameter and this also means that it does not require much sales space.

The advantage of this arrangement is that when winding hair onto the curler, if the self-gripping tape strip is laid in additional turns around the curling core, the hair laid on the curler is covered by the inside of the wound-up self-gripping tape strip and the wound-up self-gripping tape strip forms a self-sticking body for the hair which follows when winding up. The hair to be wound up thus not only comes into engagement with holding protrusions during the first winding around the self-sticking body, but also during winding around the turns made by the self-gripping tape strip around the curling core. In this manner, depending on the overall length of the self-gripping tape strip, it is possible for 5 to 6 windings of hair to be retained securely on the curler.

A further advantage lies in the fact that the curler guarantees a natural shape of curl. By virtue of the fact that the hair of a strand of hair is turned up onto a curler which initially has a relatively small diameter and then a larger diameter, a hair curl is produced which is initially tight and then to a large extent curled. This corresponds entirely to the natural occurrence of a curl.

The self-gripping tape strip preferably is of a width which corresponds to that of the self-sticking body. The circumferential surface covered by the self-sticking body then, in its entirety, undergoes an increase in the size of diameter.

For secure fastening of the self-gripping tape strip to the self-sticking body, the self-sticking body and self-gripping tape strip can be of one-piece design. A design of this type comprising just one self-gripping tape can be produced, moreover, rapidly and cost-effectively. To secure a first self-gripping tape portion as the self-sticking body on the curling core, a length of a self-gripping tape, which length corresponds to one turn of the curling core, can be laid on the curling core, and the remaining self-gripping tape portion extends therefrom as a self-gripping tape strip, wherein a certain overlap allows a fixing of the one turn basic winding on the core, preferably by welding or bonding.

The length of the self-gripping tape strip can be chosen for a selectable number of windings. The length of the self-gripping tape strip is preferably selected such that 1 to 3 windings can be made with it around the basic winding of the core.

The self-gripping projections are preferably constructed as hooks or mushroom-like projections. Such tapes have very good gripping properties for hair. The selection of the height of the projections can also have an influence on the increase in size of the diameter of the curler.

The width of the self-sticking body and hence that region of the circumferential surface of the curling core which is sheathed by the self-sticking body, may be restricted to part of the circumferential surface, in particular by free edge regions. By this means, self-gripping-free edge zones can be created which can facilitate the handling of the curler in the case of certain forms of use, for example use of chemicals. An essentially complete covering of the circumferential surface by the self-sticking body can permit the length of the curler to be minimized.

The curling core can comprise a dimensionally stable hollow core which is then preferably constructed in the form of a sieve or lattice. A curling body of this type is readily air-permeable for rapid blow-drying. Alternatively, the curling core can consist of a foam material thus giving said core a pleasant soft structure. A curler of this type can be used as day and night curler. A preferred foam material is polyethylene.

Furthermore, the self-gripping tape strip can be backed by a foil strip. In the case of a chemical treatment, in particular by means for permanent waves, it is then possible for only the new growth to be released for treatment. The remaining portion of hair strands can be securely covered by such a foil.

The self-gripping tape which can be used for the self-gripping tape strip is preferably a textile base fabric with inserted projections in the manner of a nap or looped fabric. By virtue of a preferably apertured woven or mesh structure of the base fabric, good air and/or liquid permeability can be obtained. Depending on the type of fibers used in this arrangement, in the form of monofilament and/or multifilament, the self-gripping tape strip can be produced with a relatively high or relatively low inherent stiffness.

Further developments and advantages of the invention can be learned from the following description and the subclaims.

BRIEF DESCRIPTION OF THE DRAWINGS

The invention is explained in more detail below with references to the exemplary embodiments illustrated in the attached figures.

DESCRIPTION OF SPECIFIC EMBODIMENTS

Figure 1:
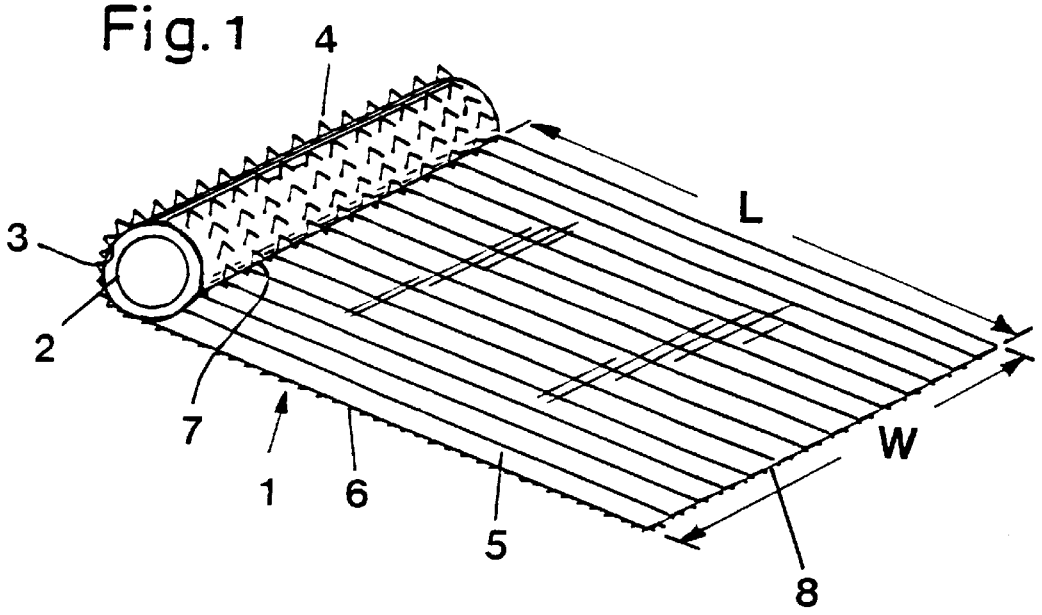
FIG. 1 shows diagrammatically a first exemplary embodiment of a curler.
Figure 2:
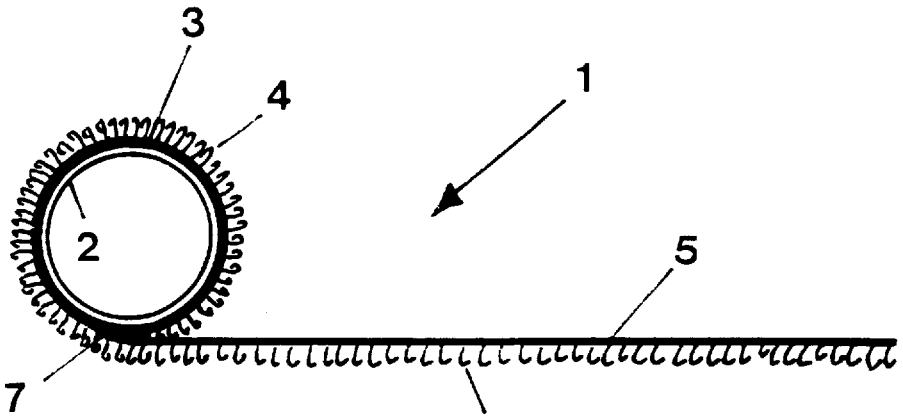
FIG. 2 shows diagrammatically a side view of the curler according to FIG. 1.

FIG. 1 and FIG. 2 show a curler 1 having a winding member or curling core 2 and a self-sticking body 3 which is seated thereon and has outwardly projecting protrusions 4. Extending radially outwards from the self-sticking body 3 is a self-gripping tape strip 5 with outwardly projecting protrusions 6 of selectable length forming a flag-shaped length. The length of the self-gripping tape strip 5 itself is selected such that the self-gripping tape strip 5 winds essentially integrally around the curling core 2 and the self-sticking body 3 (see FIG. 3).

The curling core 2 is a dimensionally stable hollow core preferably with a lattice wall for good air permeability, provided that the material used for the hollow core is not itself air-permeable.

The self-sticking body 3 and the self-gripping tape strip 5 are here formed in one piece from a hooked band which is laid, in order to form the self-sticking body 3, with one turn on the curling core 2. Along a fastening zone 7, which extends in the axial direction of the curling core 2, an initial edge of the hooked band is fastened to the continuous hooked band which then forms the self-gripping tape strip 5 which extends beyond two heads of the curling core. The fastening preferably takes place by welding or bonding. The diameter of the turn for the self-sticking body 3 is matched to the diameter of the curling core 2 so that the self-sticking body 3 is seated on the curling core 2 in a manner which is as free from the slip as is possible. If the self-sticking body 3 and the self-gripping strip 5 are produced from a hooked band, they are preferably of the same width W in the axial direction.

Figure 3:
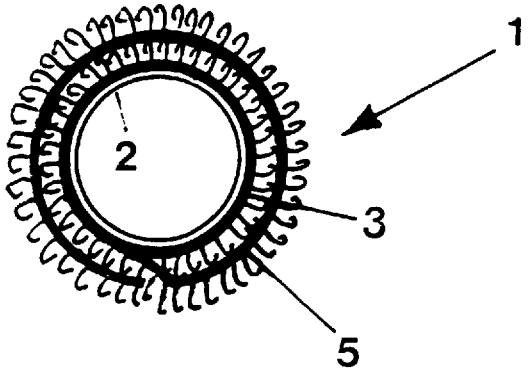
FIG. 3 shows diagrammatically a side view of the curler with a wound-up self-gripping tape strip, the length of which is matched to a complete winding.

The self-gripping tape strip 5 extends with a length L from the fastening zone 7 as far as its free end 8 and thus forms a flap-like protrusion with a generally rectangular form. The length L of the self-gripping strip 5 is selected such that the self-gripping tape strip 5 in each case integrally winds around the curler 2 and the self-sticking body 3, preferably 1 to 3 times. FIG. 3 shows the curler 1 with such a self-gripping tape strip 5 which makes one winding possible.

The length L of the self-gripping tape strip 5 can be calculated in accordance with the following formula:

$$L=n\times(d+2H)\times\pi$$

where n is the number of integral windings, d the diameter of the curling core 2 and H the height of the outwardly projecting protrusions 4, 6.

Figure 4:
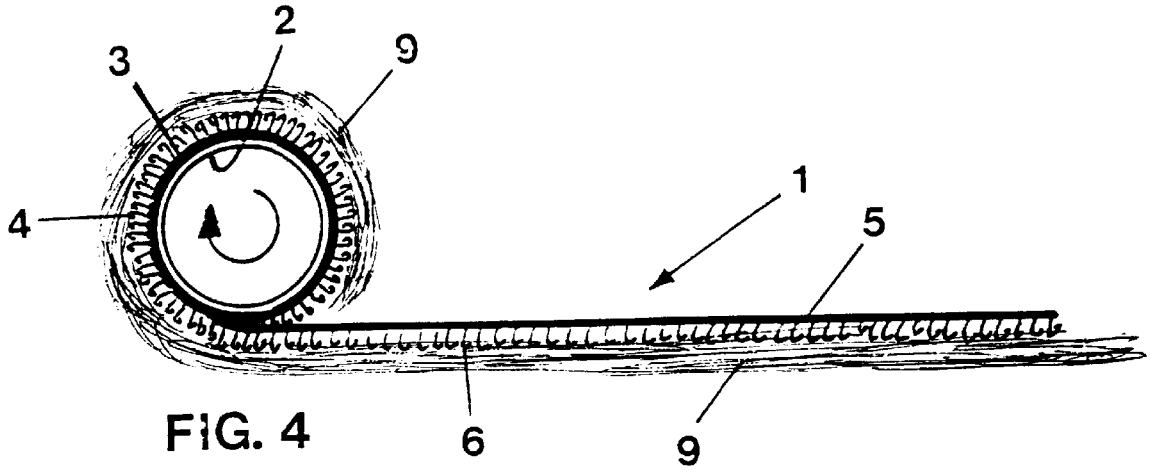
FIG. 4 shows diagrammatically the curler according to FIG. 2 together with a strand of hair to be wound up.

As can be seen from FIG. 4, when winding up a strand of hair 9, the self-gripping tape strip 5 is wound up together with the strand of hair 9. This is simplified if the self-gripping tape strip 5 preferably has a sufficient inherent stiffness. FIG. 4 makes clear that as long as the self-gripping tape strip 5 is wound up at the same time, the strand of hair 9 comes into engagement with the protrusion 6. When the self-gripping tape strip 5 is wound completely onto the curling core 2, the final form of the curler 1 is reached onto which a further length of a hair strand can then be wound. In general, up to three windings of hair are wound onto one another. The hair wound up with the self-gripping tape strip 5 generally presses into the gaps between the protrusions 4, 6, with the result that hair wound up at the same time does not enlarge the circumference.

The outsides of the self-sticking body 3 and of the self-gripping tape strip 5 have in each case a plurality of projections or protrusions 4, 6 which are arranged such that they are distributed and are in the form of hooked arms with hooks at the head end, which hooks are in one embodiment obtained by cutting open loops of a nylon monofilament. These hooks may be deformed to mushroom-like bristles by a heating process. Such a tape with mushroom-like bristles likewise has advantageous self-gripping properties. The fiber strength of the monofilament is selected such that the protrusions 4, 6 are of a sufficient stiffness. The length of the protrusions 4, 6 is preferably approximately 2 to 5 mm.

The hooked band used for the self-sticking body 3 and the self-gripping tape strip 5 is preferably a textile base fabric into which the hooked protrusions 4, 6 are inserted. The base fabric may be a woven or mesh fabric which, however, preferably has an apertured structure. Furthermore, such a hooked band can be backed, at least the self-gripping tape strip 5, with a film.

Figure 5:
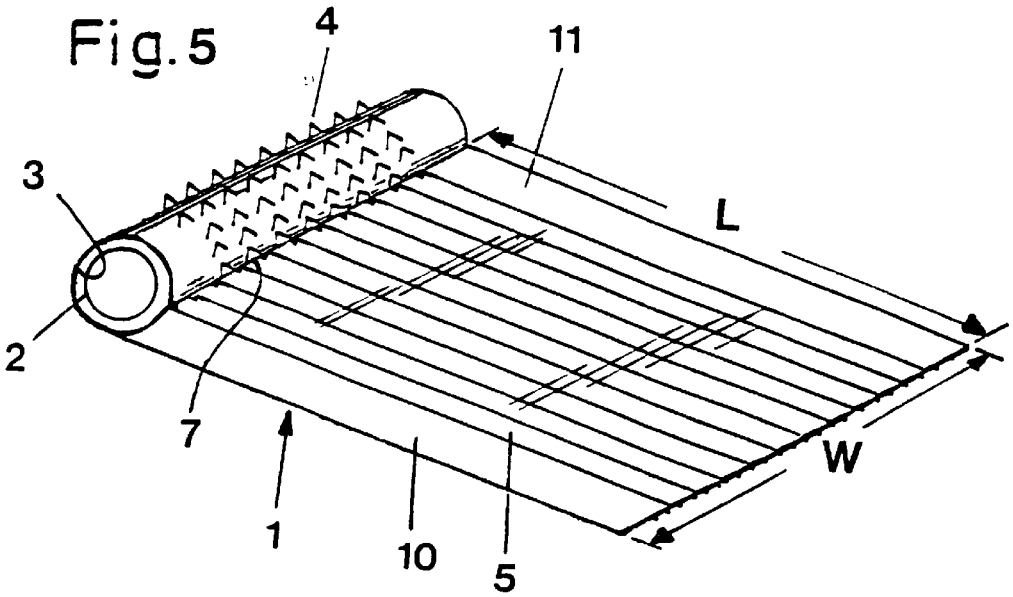
FIG. 5 shows diagrammatically a second exemplary embodiment of a curler.

The hooked protrusions 4, 6 can extend over the entire width W of the self-sticking body 3 and of the self-gripping tape strip 5. Alternatively, it is possible, as shown in FIG. 5, in the case of a second exemplary embodiment, for free lateral edge zones 10, 11 to be provided in which no protrusions 4, 6 are arranged.

The width W of the self-sticking body 3 and of the self-gripping tape strip 5 in the axial direction of the curling core 2 can essentially correspond to that of the curling core 2, i.e. the self-sticking body 3, self-gripping tape strip 5 and curling core 2 are of the same extent in the axial direction. Alternatively, the self-sticking body 3 can sheath only a subpiece of the curling core 2 in the axial direction, with the result that lateral edge zones of the curling core 2 remain free. The self-sticking body 3 preferably sheaths at least half of the curling core 2 in the axial direction.

According to a further exemplary embodiment, which is not shown, the self-gripping tape strip 5 can be fastened to the self-sticking body 3 as a separate part and can then be of a smaller or larger width W than the self-sticking body 3.

Figure 6:
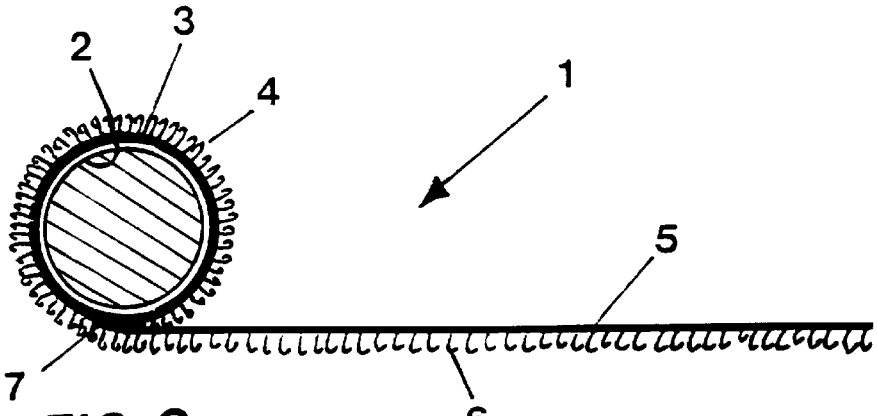
FIG. 6 shows diagrammatically a side view of the third exemplary embodiment of a curler.

FIG. 6 shows a third exemplary embodiment of the curler, in which the curling core 2 is formed by a cylinder portion made of foam. Polyethylene is preferred as plastic material. Otherwise, the above description applies correspondingly.

The curlers 1 described can be produced with curling cores 2 of different diameters and with different axial extents.

The invention now being fully described, it will be apparent to one of ordinary skill in the art that many changes and modifications can be made thereto without departing from the spirit or scope of the appended claims.

What is claimed is:

1. A hair curler comprising:

a curling core onto which a lock of hair can be wound;

a self-gripping tape having a self-sticking body portion being seated on the curling core and having a strip portion of a predetermined length projecting laterally in form of a flag-shaped length beyond the curling core, that strip portion being wound onto the curling core together with the lock of hair;

said strip portion being attached by one edge to the curling core, and the length of which being selected such that said strip portion winds essentially integrally around the curling core; and said self-gripping tape having outwardly projecting protrusions covering the outside of the strip portion.

2. A hair curler according to claim 1 wherein said self-sticking body portion and said strip portion are formed by a hooked band which has outwardly projecting protrusions, is seated, by means of a turn, on the curling core, which turn is secured by fastening an initial edge portion of the hooked band to the hooked band, and projects outwards with the remaining hooked-band portion.

3. A hair curler according to claim 2, wherein the fastening takes place by welding hooked-band portions to one another.

4. A hair curler according to claim 1, wherein said strip portion is of a length (L) which is calculated in accordance with $$L=n\times(d+2H)\times\pi,$$

where n is the number of integral windings, d is the diameter of the curling core, and H is the height of the outwardly projecting protrusions.

5. A hair curler according to claim 1, wherein said strip portion extends radially outwards with such a length (L) that the number of windings amounts to 1 to 3.

6. A hair curler according to claim 1, wherein said outwardly projecting protrusions are formed by cut-open loops of a nylon monofilament yarn.

7. A hair curler according to claim 6, wherein said cut-open loops of the nylon monofilament yarn are deformed in a mushroom-shape manner by heat treatment.

8. A hair curler according to claim 1, wherein said outwardly projecting protrusions have a height of approximately 2 to 5 mm.

9. A hair curler according to claim 1, wherein said self-sticking body portion sheaths at least half of the axial extent of said curling core.

10. A hair curler according to claim 1, wherein said strip portion is attached to said curling core in such a way that it can be wound onto said curling core with the outside being a hair facing side for the curling.

11. A hair curler according to claim 1, wherein said self-sticking body portion essentially completely sheaths the curling core in the axial direction.

12. A hair curler according to claim 1, wherein said curling core is formed by a dimensionally stable hollow spool having a lattice wall.

13. A hair curler according to claim 1, wherein said curling core is formed by a cylinder portion made of foam.

14. A hair curler according to claim 13, wherein said curling core consists of foamed polyethylene.

15. A hair curler according to claim 1, wherein said self-gripping tape has lateral edge regions which do not have outwardly projecting protrusions.

16. A hair curler according to claim 1, wherein said self-gripping strip portion is at least partially backed by a film clip.

17. A hair curler according to claim 1, wherein said self-gripping tape is formed by a textile base fabric having inserted protrusions, the base fabric having crossings of the threads for an apertured woven structure.

18. A hair curler according to claim 1, wherein said self-gripping tape is of relatively stiff construction.

19. A hair curler according to claim 2, wherein the fastening takes place by bonding hooked-band portions to one another.

20. A hair curler according to claim 1, wherein said self-gripping tape is formed by a textile base fabric having inserted protrusions, the base fabric having crossings of the threads for an apertured mesh structure.

* * * * *